US007528688B2

(12) United States Patent
Srinivasan

(10) Patent No.: US 7,528,688 B2
(45) Date of Patent: May 5, 2009

(54) FERRITE-PIEZOELECTRIC MICROWAVE DEVICES

(75) Inventor: Gopalan Srinivasan, Rochester, MI (US)

(73) Assignee: Oakland University, Rochester, MI (US)

( * ) Notice: Subject to any disclaimer, the term of this patent is extended or adjusted under 35 U.S.C. 154(b) by 243 days.

(21) Appl. No.: 11/494,427

(22) Filed: Jul. 27, 2006

(65) Prior Publication Data

US 2009/0085695 A1 Apr. 2, 2009

Related U.S. Application Data

(60) Provisional application No. 60/703,738, filed on Jul. 29, 2005.

(51) Int. Cl.
*H01P 7/00* (2006.01)
*H01P 1/20* (2006.01)
*B22F 7/02* (2006.01)

(52) U.S. Cl. ..... 333/219.2; 333/202; 428/548

(58) Field of Classification Search ..... None
See application file for complete search history.

(56) References Cited

U.S. PATENT DOCUMENTS 4,769,599 A 9/1988 Mermelstein
5,130,654 A 7/1992 Mermelstein
5,512,196 A 4/1996 Mantese et al.
5,538,941 A * 7/1996 Findikoglu et al. ..... 505/210
5,675,252 A 10/1997 Podney
5,856,770 A 1/1999 Mantese et al.
6,279,406 B1 8/2001 Li et al.
6,498,549 B1 * 12/2002 Jiang et al. ..... 333/202
6,501,971 B1 12/2002 Wolf et al.
6,919,783 B2 * 7/2005 Dionne et al. ..... 333/205
7,226,666 B2 * 6/2007 Srinivasan ..... 428/548
2001/0028245 A1 10/2001 Li et al.
2001/0040450 A1 * 11/2001 Li et al. ..... 324/260
2003/0197576 A1 10/2003 Dionne et al.
2005/0104474 A1 * 5/2005 Srinivasan ..... 310/311

OTHER PUBLICATIONS

Astrov, D.N., Soviet Phys. JETP 13 729 (1961).
Rado, G.T., et al., Phys. Rev. Lett. 7, 310 (1961).
Foner, S., et al., J. Appl. Phys. 34 1246 (1963).
Kornev, I., et al., Phys. Rev. B 62, 12247 (2000).
VanSuchtelen,Philips Res. Rep., 27, 28 (1972).
Van den Boomgaard,J., et al., J. Mater. Sci. 9, 1705 (1974).
Van den Boomgaard,J., et al., Ferroelectrics 14 727 (1976).
Van den Boomgaard, J., et al., J. Mater. Sci. 13 1538 (1978).
Harshe, G., et al., Int. J. Appl. Electromag. Mater. 4 145 (1993).
Avellaneda, M., et al., J. Intell. Mater. Sys. Struc. 5, 501 (1994).
Srinivasan, G., et al., Phys. Rev. B 64, 214408 (2001).
Ryu, J., et al., Jpn. J. Appl. Phys. 40, 4948 (2001).
Bichurin, M.I., et al., Rhys. Rev. B, 64 094409 (2001).

(Continued)

*Primary Examiner*—Rexford Barnie
*Assistant Examiner*—Dylan White
(74) *Attorney, Agent, or Firm*—Ian C. McLeod

(57) ABSTRACT

Devices for modification of a microwave signal using a magnetically saturated ferrite magnetoelectric device with electrical control are disclosed. The device is useful for microwave resonators, band pass filters, delay lines and phase shifters.

6 Claims, 10 Drawing Sheets

OTHER PUBLICATIONS

Shastry, S., et al., Phys. Rev. B.70, 064416 (2004).
Schmid, H.: Introduction to complex mediums for optics and electromagnetics, Eds. W.S. Weighlhofer and A. Lakhtakia, SPIE PressBellingham, WA (2003). pp. 167-195.
Adam, J.D., and Stitzer, S.N.: Appl. Phys. Lett. 36, 485 (1980).
Tsai, C.S. and Su, J.: Appl. Phys. Lett. 74, 2079 (1999).
Bichurin, M.I., Petrov, R.V.and Kiliba, Yu. V: Ferroelectrics204, 311 (1997).
Bichurin, M. I., Petrov, V.M., Kiliba, Yu. V., And SrinivasanG: Phys. Rev. B. 66, 134404 (2002).
Carter, P.: IEEE Trans. MTT, 13, No. 3 (1965).
Adam, J.D., et al., Physics of Thin Films-Advancesin Research and Development (AP, Boston, 1991).
Adkins, L.R., et al., J. Appl. Phys, 55, 2518 (1984).
Anfinogenov, V.B., Sov. Tech. Phys. Lett. 12, 389 (1986).
Demidov, E., et al., J. Appl. Phys. 91, 10007 (2002).
Fetisov, Y.K. and Kudryashkin, I.G., Sov. Tech. Phys. Lett. 15, 47 (1989).
Demidov, V.E., et al., IEEE Trans. MTT, 51, 1576 (2003).
Ishak, W.S., Proc. IEEE, 1998, v. 91, No. 2, p. 171.
Damon, R.W., et al., J. Phys. Chem. Solids, 1961, v. 19, No. 3/4, p. 308.
Shastri, S. et al., Phys. Rev. B., 2004, v. B70, p. 064416.
Seshadri, S.R., Proc. IEEE, 1970, v. 58, No. 3, p. 506.
Lyashenko, N.I., et al., Radiotechnika I Elektronika, 1994, v. 39, No. 7, p. 1164 (in Russian).

* cited by examiner

RESONATOR

RESONATOR

RESONATOR

BAND PASS FILTERS

BAND PASS FILTERS

DELAY LINES

DELAY LINES

DELAY LINES

PHASE SHIFTERS
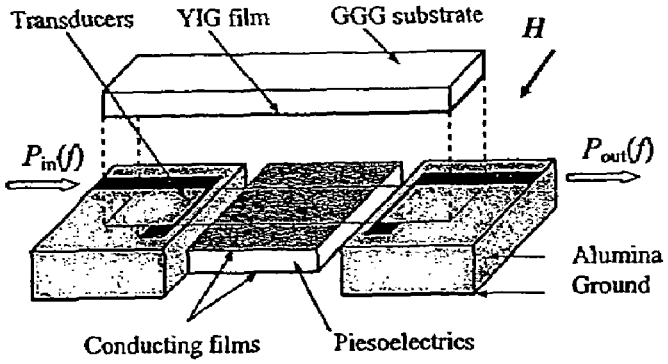
FIGURE 11
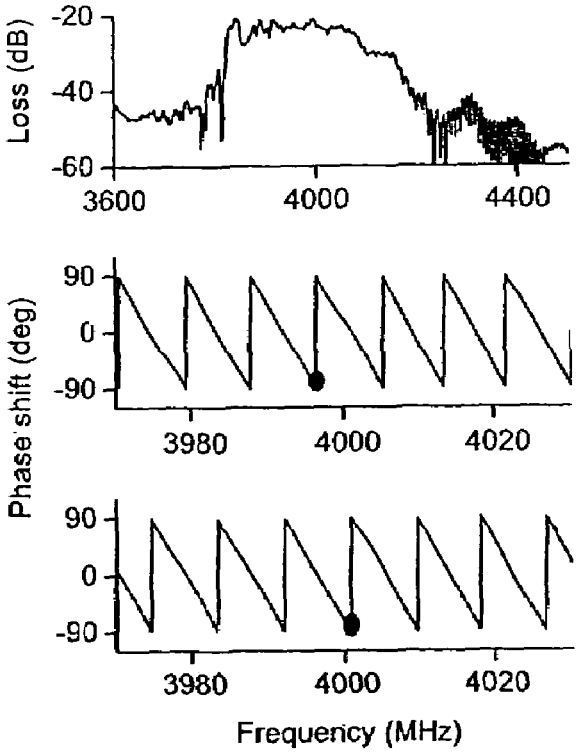
FIGURE 12A
FIGURE 12B
FIGURE 12C

PHASE SHIFTERS
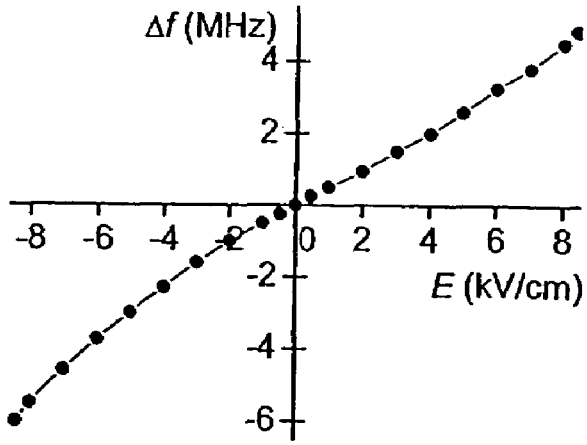
FIGURE 13
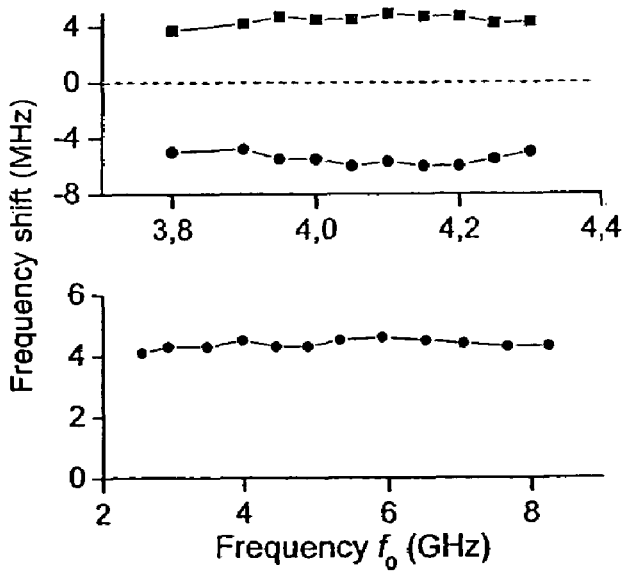
FIGURE 14A
FIGURE 14B

FERRITE-PIEZOELECTRIC MICROWAVE DEVICES

CROSS-REFERENCE TO RELATED APPLICATIONS

This application claims priority to U.S. Provisional Application Ser. No. 60/703,738 filed on Jul. 29, 2005, which is incorporated herein by reference in its entirety.

STATEMENT REGARDING GOVERNMENT RIGHTS

This invention was supported by the Office of Naval Research, Grant No. N00014-05-1-0664 and the Army Research Office Grant No. W911NF-04-1-0299. The U.S. Government has certain rights to the present invention.

STATEMENT REGARDING FEDERALLY SPONSORED RESEARCH OR DEVELOPMENT

Not Applicable

BACKGROUND OF THE INVENTION (1) Field of the Invention

The present invention relates to signal processing at microwave frequencies without significant power loss by electrical control of a magnetoelectric (ME) device with a magnetically saturated ferrite layer and a piezoelectric layer which induces an added magnetic field in the ferrite in response to an electrical field in the ME device.

(2) Description of the Related Art

U.S. Patent Application No. 2003/0197576 A1 to Dionne et al describes a tunable microwave device. In this invention, a magnetically unsaturated ME device is electrically controlled to establish a domain pattern in the magnetic layer. The problem is the magnetic field is different to directionally control relative to the conductor for the microwaves.

U.S. patent application Ser. No. 10/354,863 filed Jan. 30, 2003 to Srinivasan which is incorporated herein by reference in its entirety describes magnetoelectric (ME) devices. The improved device comprises a composite of a layer of $La_{1-n}A_nMn03$ wherein n is less than 1 and A is strontium or calcium and a layer of a piezoelectric composition. It also describes ME devices in general.

In a single-phase material, ME effects require long range ordering of atomic moments and electric dipoles. There are few such materials and the effect is often weak (Astrov, D. N., Soviet Phys. JETP 13 729 (1961); Rado, G. T., et al., Phys. Rev. Lett. 7, 310 (1961); Foner, S., et al., J. Appl. Phys. 34 1246 (1963); and Kornev, I., et al., Phys. Rev. B 62, 12247 (2000)). For the engineering of materials with new or improved properties; Van Suchtelen proposed product-property composites (Van Suchtelen, Philips Res. Rep., 27, 28 (1972)). For example, composites with magnetostrictive (m) and piezoelectric phases (p) are expected to be magnetoelectric because of mechanical stress mediated electromagnetic coupling. Most studies in the past focused exclusively on ferrite-PZT/$BaTiO_3$ composites. Van den Boomgaard synthesized bulk composites of $CoFe_2O_4$/$NiFe_2O_4$ and $BaTiO_3$ (Van den Boomgaard, J., et al., J. Mater. Sci. 9, 1705 (1974); Van den Boomgaard, J., et al., Ferroelectrics 14 727 (1976); and van den Boomgaard, J., et al., J. Mater. Sci. 13 1538 (1978)). The mixed oxides yielded ME coefficients much smaller than calculated values due to leakage currents through low resistivity ferrites and microcracks that resulted from mismatch of structural parameters and thermal properties. The problem with low resistivity ferrites can be eliminated in a layered structure. Theories predict a very large ME coefficient in a bilayer of p- and m-phases due to enhanced piezoelectricity, but measured values in $CoFe_2O_4$—PZT were small (Harshe, G., et al., Int. J. App Electromag. Mater. 4 145 (1993); Avellaneda, M., et al., J. Intell. Mater. Sys. Struc. 5, 501 (1994); and Harshe, G., Magnetoelectric effect in piezoelectric-magnetostrictive composites, Srinivasan PhD thesis, Pennsylvania State University, College Park, Pa. (1991)). The inventor recently reported giant ME coefficients in bilayers and multilayers of nickel ferrite—PZT (Srinivasan, G., et al., Phys. Rev. B 64, 214408 (2001)), and a record high ME effect was reported very recently in trilayer composites of PZT with Terfenol-D (Ryu, J., et al., Jpn. J. Appl. Phys. 40, 4948 (2001)). The recent theoretical model for a ferrite-PZT bilayer predicts a strong ME effects at microwave frequencies (Bichurin, M. I., et al., Phys. Rev. B, 64 094409 (2001)). Lanthanum manganites with divalent substitutions have attracted considerable interest in recent years due to double exchange mediated ferromagnetism, metallic conductivity, and giant magnetoresistance (Ramirez, A. P., J. Phys.: Condens. Mater 9, 8171 (1997)). The manganites are useful for ME composites because of (i) high magnetostriction and (ii) metallic conductivity that eliminates the need for a foreign electrode at the p-m interface.

The patent art of magnetoelectric composites is well developed as shown by U.S. Pat. Nos. 4,769,599 and 5,130,654 to Mermelstein; 5,512,196 and 5,856,770 to Mantese et al; 5,675,252 to Podney and 6,279,406 to Li et al. Additional art is shown in U.S. Publications 2001/0040450 A1 and 2001/0028245 A1 to Li et al. All of these patents and applications are incorporated by reference herein.

U.S. Pat. No. 6,498,549 to Jiang et al describes a substrate consisting of a magnetic oxide (yttrium iron garnet-YIG) and a dielectric (barium strontium titanate-BST). They then deposit a conductor on top of this substrate. The idea is to use magnetic and electric tuning for a variety of devices based on propagation of high frequency signal in the conductor.

U.S. Pat. No. 6,501,971 to Wolf et al describes a magnetic field tunable ferrite device.

OBJECTS

It is an object of the present invention to provide an improved device which eliminates the need for directional control of the magnetic field. It is further an object of the present invention to provide a device which is economical to construct and can be miniaturized easily on a microchip. These and other objects will become increasingly apparent from the following description and the drawings.

SUMMARY OF THE INVENTION

The present invention relates to four (4) types of devices.

(a) A resonator;

(b) Band-pass or band-stop filter based using the resonator;

(c) A delay line (that lets waves with different frequencies propagate with different speed and enables separation in time domain); and (d) A phase shifter.

In all these cases, the tuning mechanism is the same as described below.

Traditional tuning of ferrite devices: Ferrite devices require a magnetic field for operation. To tune the operating frequency, one therefore changes the magnetic field applied to the device.

Electric field tuning of ferrite/piezoelectric devices: A ferrite/piezoelectric element (ferrite is bonded to the piezoelectric) replaces the ferrite. An electric field applied to the structure then produces a mechanical strain due to the piezoelectric effect. This force is transmitted to the ferrite and manifests as "a magnetic field." Thus one has a conversion of "electric-to-magnetic field" and device tuning.

A magnetoelectric resonator or a band-stop filter is a device that produces a resonant absorption only at a specific frequency. The resonance frequency is a function of magnetic field applied to the ferrite. In a composite, the electric field-to-magnetic field conversion allows tuning of the device without having to resort to magnetic tuning which is very slow and requires a lot of power.

Thus, the present invention provides a device capable of modification of a microwave input which comprises: at least one conductor, such as a microstrip, as input and output of microwaves on a ground plane; and a magnetoelectric (ME) device comprising a ferrite layer which is magnetically saturated and positioned on or in close proximity of the conductor and a piezoelectric layer bonded to the ferrite layer, wherein an electric field applied to the piezoelectric layer appears as a magnetic field in the ferrite, leading to modification of the microwave input. In further embodiments, the ferrite layer is a single crystal (or epitaxial film) of yttrium iron garnet (YIG) or a rare-earth or trivalent ion substituted YIG. In still further embodiments, the garnet is deposited on a substrate of gallium gadolinium garnet (GGG). In still further embodiments, the piezoelectric layer is lead zirconate-titanate (PZT) or lead magnesium niobate-lead titanate (PMN-PT). In still further embodiments, the device is adapted for a microwave frequency range of 1 to 20 GHz.

The present invention provides a device capable of electrical tuning of resonance frequency of a ferrite resonator: a metal conductor such as a microstrip as input and output of microwaves on a ground plane; and a magnetoelectric (ME) device comprising a ferrite layer which is magnetically saturated and positioned on or in close proximity of the conductor and a piezoelectric layer bonded to the ferrite layer, wherein an electric field applied to the piezoelectric layer appears as a magnetic field in the ferrite, leading to the frequency tuning of the resonator. In further embodiments, the ferrite layer is a single crystal (or epitaxial film) of yttrium iron garnet (YIG) or a rare-earth or trivalent ion substituted YIG. In still further embodiments, the garnet is deposited on a substrate of gallium gadolinium garnet (GGG). In still further embodiments, the piezoelectric layer is lead zirconate-titanate (PZT) or lead magnesium niobate-lead titanate (PMN-PT). In still further embodiments, the device is adapted for a microwave frequency range of 1 to 20 GHz.

The present invention provides a device for electrical tuning of the operating frequency of a ferrite band-pass filter which comprises: input and output metal conducting strips (microstrips) spaced apart on non-conductive substrate (ground plane); a piezoelectric layer with conductive layers on opposed sides of the layer; and a ferrite film which is magnetically saturated mounted on the strips and bonded to one of the conductive electrode on the piezoelectric layer, wherein an electric field in the piezoelectric layer produces magnetostriction and additional magnetic field in the ferrite layer to produce a change in the resonant frequency thereby tuning the operating frequency. In further embodiments, the ferrite film is a single crystal of yttrium gadolinium garnet (YIG) or substituted YIG. In still further embodiments, the garnet is deposited on a substrate of gallium gadolinium garnet (GGG). In still further embodiments, the piezoelectric layer is lead zirconate-titanate (PZT) or lead magnesium niobate-lead titanate (PMN-PT). In still further embodiments, the device is adapted for a frequency range of 1 to 20 GHz. In still further embodiments, the device is provided as a microchip.

The present invention provides a device for electrical control of delay time in a delay line which comprises: an epitaxial ferrite film of yttrium iron garnet which is magnetically saturated and deposited on a gadolinium gallium garnet (GGG) as a substrate; a piezoelectric layer of lead magnesium niobate-lead titanate (PMN-PT) with conducting films on opposed sides of the layer, wherein a portion of the one of the conducting films is bonded to the ferrite film, for providing an electrical field to the piezoelectric layer; input and output metal microwave conducting strips (such as microstrips) mounted on spaced apart non-conductive supports (ground plane) mounted on opposed sides of the piezoelectric layer with the ferrite film which is in contact with the strips; and wherein an electric field applied to the piezoelectric layer produces a magnetostriction of ferrite film layer and resulting in a change in the time of propagation of microwaves between the strips.

The present invention provides a device for electrical control of phase shift in a phase shifter which comprises: an epitaxial ferrite film of yttrium iron garnet which is magnetically saturated and deposited on a gadolinium gallium garnet (GGG) as a substrate; a piezoelectric layer of lead magnesium niobate-lead titanate (PMN-PT) or PZT with conducting films on opposed sides of the layer, wherein a portion of the one of the conducting films is bonded to the ferrite film, for providing an electrical field to the piezoelectric layer; input and output metal microwave conducting strips (such as microstrips) mounted on spaced apart non-conductive supports (ground plane) mounted on opposed sides of the piezoelectric layer with the ferrite film which is in contact with the strips; and wherein an electric field applied to the piezoelectric layer produces a magnetostriction of ferrite film layer and a resulting in a change in the phase shift for microwaves propagating from the input to output through the film.

BRIEF DESCRIPTION OF THE DRAWINGS

FIG. 11 is a schematic of a new MSW phase-shifter based on ferrite film-piezoelectric layered structure.

FIGS. 12A, 12B, and 12C are graphs showing the characteristics of the phase shifter: FIG. 12A—insertion loss L vs. f response, FIG. 12B—phase vs. f response for E=0 and, FIG. 12C—for E=8 kV/cm.

FIG. 13 is a schematic of an electrical tuning of phase characteristics of the MSW phase-shifter.

FIGS. 14A and 14B are a schematic frequency shift of the phase characteristics as a function of the operating frequency: FIG. 14A—for H=754 Oe, FIG. 14B—for H=336 . . . 2200 Oe, E=±8 kV/cm.

DESCRIPTION OF PREFERRED EMBODIMENTS

All patents, patent applications, government publications, government regulations, and literature references cited in this specification are hereby incorporated herein by reference in their entirety. In case of conflict, the present description, including definitions, will control.

EXAMPLE 1

Resonator

We demonstrate the electric field tunability of FMR over 2-20 GHz in a YIG-PZT bilayer in a microstripline structure. The FMR frequency is tuned due to magnetostriction induced variation in internal magnetic field in the mechanically deformated epitaxial ferrite film. This deformation, in its turn, due to electrostriction of the piezoelectric layer of the structure. Such ferrite-piezoelectric structures forms the basis for passive electrically tuned microwave resonators and filters.

Introduction

Composite materials consisting of magnetically- and electrically ordered phases (volume or layered) posses a magnetoelectric (ME) interaction which exhibits as an influence of electrical field on magnetic properties and influence of magnetic field on electrical properties of the matter (L. D. Landau and E. M. Lifshitz, *Electrodynamics of Continuous Media*, Pergamon Press, Oxford (1960) p. 119 (Translation of Russian Edition, 1958)). The interaction is realized through a deformation due to mechanical coupling of the structure components. The ME interaction as such structures is of 1-2 order in magnitude stronger, than in a single-phase materials, for example, in $Cr_2O_3$ (Astrov, D. N., "Magnetoelectric effect in chromium oxide," Soviet phys. JETP 13, 729 (1961)). An electrical polarization in external magnetic field have been observed in composites of different content (Van Suchtelen, "Product properties: A new application of composite materials," Philips Res. Rep., 27, 28 (1972); G. Srinivasan, E. T. Rasmussen, J. Gallegos, R. Srinivasan, Yu. I. Bokhan, and V. M. Laletin, Phys. Rev. B 64, 214408 (2001)).

An influence of external electrical field on the ferromagnetic resonance (FMR) frequency in a bilayer structure consisting of a yttrium-iron garnet film and a PMN-PT plate has been shown recently ("Microwave magnetoelectric effects in single crystal bilayers of yttrium iron garnet and lead magnesium niobate-lead titanate," S. Shastry, G. Srinivasan, M. I. Bichurin, V. M. Petrov, and A. S. Tatarenko, Phys. Rev. B. 70, 064416 (2004)).

This invention demonstrates a possibility to tune the FMR frequency in a bilayer structure consisting of a YIG film and a lead-zirconium titanate (PZT) piezoelectric plate with an external DC electrical field. The phenomenon can be used to elaborate electrically controlled ferromagnetic resonators and filters for microwave frequency band applications.

2. Resonator Experimental Set Up

Figure 1:
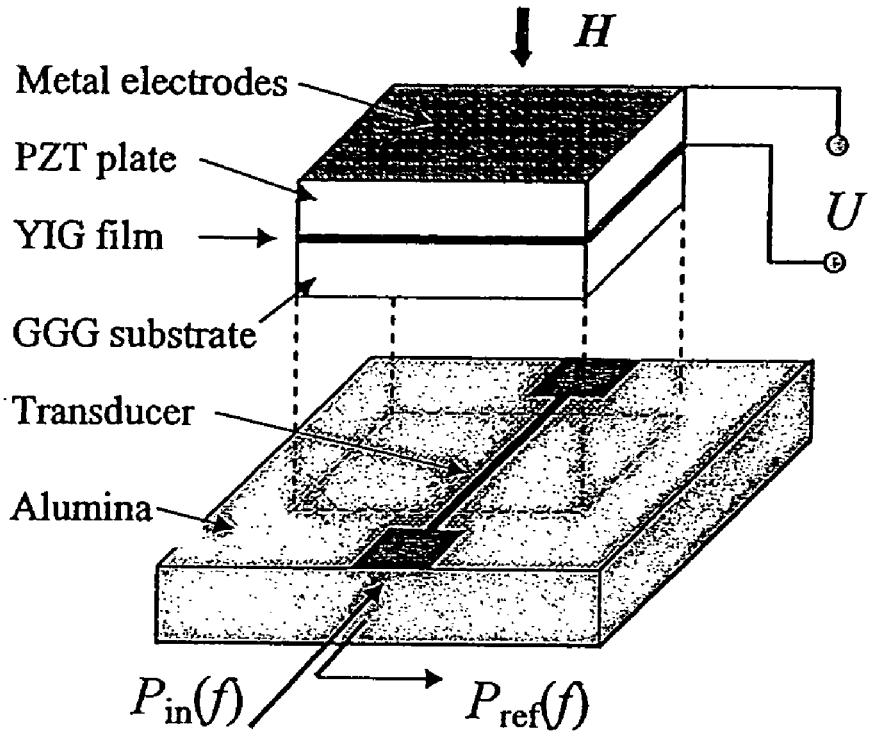
FIG. 1 is a schematic drawing of a ferrite-piezoelectric resonator structure.

A schematic of the bilayer structure is shown in FIG. 1. A YIG film of the thickness of 15 μm and lateral dimensions of 1×2.2 $mm^2$ was used in measurements. The film was grown by the liquid-phase epitaxy on one side of the gallium gadolinium garnet (GGG) substrate of (111) orientation. The film had a saturation magnetization of 1750 G and uniform FMR line width of ~0.6 Oe, measured at 5 GHz frequency. A PZT plate of dimensions of 0.5×4×4 $mm^3$ was used for a piezoelectric phase. Both sides of the PZT plate were covered with a ~5 μm thick Ag layers. In order to provide mechanical coupling, the ferrite film was bound to the PZT surface with a thin layer of fast-dry epoxy glue. The structure was placed in between the poles of an electromagnet in an external magnetic field H, directed tangentially or normally to the structure plane. A microstrip transducer of 50 μm width and 3 mm length, fabricated on an alumina substrate, was used to excite the FMR in the structure. The YIG film was separated with a ~0.5 mm thick gap from the transducer. A dc electrical field E with a magnitude up to 10 kV/cm was created in PZT plate by applying a voltage to the metalized surfaces of the plate. The measurements were carried out using a network analyzer HP-8720D. A dc input signal of the frequency f=1-10 GHz and power $P_{in}$ up to 0.1 mW was applied to the transducer. Low power level was chosen to prevent heating of the sample due to absorption of microwave power. The spectra of reflected power $P_{ref}(f)$ were measured over the frequency band for different values of magnetic H and electrical E fields.

3. Experimental Results

Figure 2:
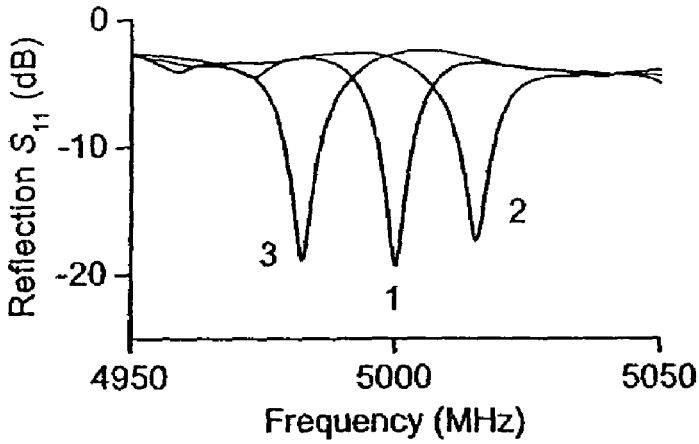
FIG. 2 is a graph of FMR reflection spectra of the YIG-PZT structure: 1—without electrical field, 2—E=+10 kV/cm, 3—E=−10 kV/cm.

FIG. 2 shows typical reflection spectrum, that is dependence of $S_{11}(f)=20 \log [(P_{ref}(f)/P_{in}(f)]$ as a function of frequency, for a tangentially magnetized structure at fixed magnetic field H=1.12 kOe. The spectrum contained one well expressed absorption peak with maximum insertion loss more than −16 dB and line width of Δf=3.4 MHz at the −3 dB power absorption level. The peak shifted on $\delta f_1$=16 MHz to the high frequency region when dc electrical field E=10 kV/cm (which we call positive below) was applied to the PZT plate. The peak shifted on the $\delta f_1$=−18 MHz to the low frequency region when direction of the electrical field was reversed. One can see from FIG. 2, that the shape of the peak was not changed considerably after the shifts.

Similar tuning of the absorption peak was observed for a normally magnetized YIG-PZT structure as well. However, for this case, directions of the peak shifts were opposite to the previous ones and values of the shifts were bigger. The peak shifted on $\delta f_2$=−22.5 MHz to the low frequency region when electrical field of positive direction E=10 kV/cm was applied to the PZT plate. The peak shifted on $\delta f_2$=24.5 MHz to the high frequency region when direction of E was reversed.

Note, that electrical tuning of the absorption peak was not observed when there was no mechanical coupling between the YIG film and the PZT plane, for example, when they were just pressed to each other or when they were coupled with a rubber cement. Absorption peaks in FIG. 2 correspond to FMR excitation in the YIG film. For a thin ferromagnetic film of infinite dimensions, magnetized tangentially or normally with respect to its plane, resonance frequencies are given by the approximate formulas (Kittel formulas (1) and (2)), respectively:

$$f_2=\gamma\sqrt{H(H+4\pi M)} \quad (1)$$

$$f_1=\gamma\sqrt{(H-4\pi M)} \quad (2)$$

Notations here are as follows: H is the external magnetic field, 4πM is the saturation magnetization, γ is the absolute value of the gyromagnetic ratio. Consideration of finite lateral dimensions of the film, metallization of the film surface, and crystallographic anisotropy fields of ferrite results in a small permanent shift in the FMR frequency with respect to the values given by Eqs. (1) and (2). Relative value of the shift does not exceed ~0.1% for the experimental conditions and depends very weakly on H. It does not take into account this frequency shift in the following estimations.

Figure 3:
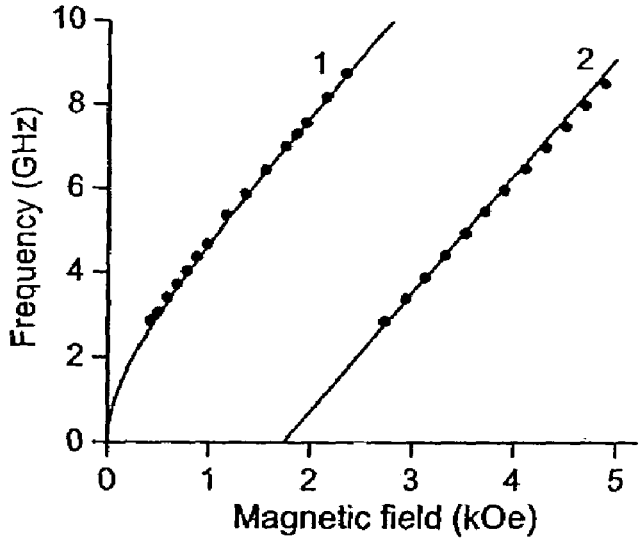
FIG. 3 is a graph showing dependence of FMR frequency vs magnetic field for YIG-PZT structure: 1—tangential magnetization, 2—normal magnetization. Dots are experimental data, solid lines—calculation.

FIG. 3 shows measured magnetic field dependences of FMR frequencies $f_1$ and $f_2$ for tangentially and normally magnetized structure at E=0, respectively. Solid lines are theoretical dependences calculated using Eqs. (1) and (2) for the parameters values corresponding to experiment: 4 nM=1750 G and γ=2.8 MHz/Oe. One can see, that for both field orientations in the frequency tuning range 2.8-8.8 GHz, the data are well described by the theory. No measurements were carried out at frequencies lower than 2.5 GHz because of the resonance widening due to nonlinear damping, and at frequencies upper than 9 GHz because of a drop in the efficiency of FMR excitation with a microstrip transducer.

Figure 4:
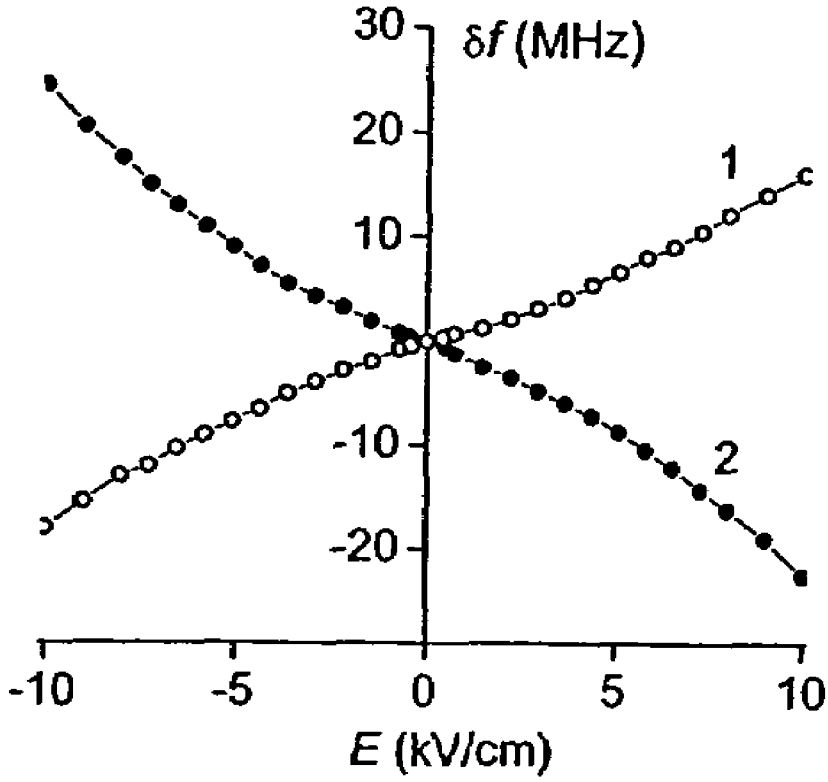
FIG. 4 is a graph showing electrical tuning of the FMR frequency in YIG-PZT structure: 1—tangential magnetization, 2—normal magnetization. Central frequency is 5 GHz. Dots are experimental data.

FIG. 4 shows dependences of the frequency shifts $\delta f_1 \in \delta f_2$ as functions of electrical field E. Data have been taken near central frequency f=5 GHz, and for fixed values of tangential field H=1.07 kOe and normal field H=3.53 Oe. In order to get rid of hysteresis type repolarization phenomena in piezoelectrics, after reversal of the E field direction, the PZT plate was first saturated in maximum field E=10 kV/cm, and then the dependence δf(E) was measured at increasing electrical field. It is seen, that shift in the FMR frequency is a nonlinear function of applied electrical field for both E directions. Value of the frequency shift is a little bit bigger for reversed electrical field direction.

4. Explanation and Discussion

The shift of the FMR frequency in the bilayer structure is due to magnetoelectric interaction. Application of an electrical field to the PZT plate brings about an expansion or constriction of the piesoelectrics, depending on the E direction. This results in a deformation of the YIG film, which is mechanically coupled to the PZT plate. Magnetostriction of the ferrite, in turn, results in a variation of effective internal magnetic field inside ferrite that produces a shift in the FMR frequency.

Using measured maximum values of the frequency shifts and Eqs. (1) and (2), one can calculate values of magnetostriction induced magnetic field 5H in a ferrite. For tangentially magnetized film one gets $5H_1$=5.77 Oe, and for normally magnetized film $-\delta H_2$=8.75 Oe. Corresponding values of ME coefficients are: for tangentially magnetized film $A_1=\delta H_1/E\approx 0.58$ Oe·cm/kV, and for normally magnetized film $A_2=\delta H_2/E\approx 0.88$ Oe·cm/kV. These values are of the same order as recently observed value for ME coefficient A≈1-4 Oe·cm/kV in a YIG-PMN-PT bilayer structure ("Microwave magnetoelectric effects in single crystal bilayers of yttrium iron garnet and lead magnesium niobate-lead titanate," S. Shastry, G. Srinivasan, M. I. Bichurin, V. M. Petrov, and A. S. Tatarenko, Phys. Rev. B. 70, 064416 (2004)).

In order to confirm the proposed mechanism of electrical FMR frequency tuning, the direct measurements of the PZT plate deformation have been done using a strain gage technique. Relative expansion up to 440 ppm and relative constriction up to −500 ppm for the PZT plate were observed when it was subjected to electrical fields of E=10 kV/cm with positive and reversed directions, respectively. Magnitude of the deformation is a nonlinear function of the electrical field, similarly to the dependence shown in FIG. 4. It follows a linear relation between the FMR frequency shift and the deformation. Different values of relative deformations corresponding to expansion and constriction of the ferrite film account for different values of the frequency shifts for positive and reversed directions of E.

Similar measurements of electrical field tuning of the FMR frequency have been carried out using YIG films of the same lateral dimensions but different thicknesses. The FMR frequency shift for a normally magnetized structure decreased from 40 MHz to 12 MHz as YIG film thickness was increased from 4.1 up to 50 μm. This certifies a non-uniform distribution of the deformations as one moves inside from the ferrite film surface, that results in a decrease in the mean magnetostrictive change of internal magnetic field. No frequency shift caused by heating of the ferrite-piezoelectric structure (which could be only down-shift because of decrease in the ferrite magnetization) has been observed.

Thus, this invention has demonstrated a tunability of the FMR frequency in the YIG-PZT bilayer structure by applying an external electrical field to the piezoelectrics. The FMR frequency is tuned due to magnetostriction induced variation in internal magnetic field in the mechanically deformated ferrite film. This deformation, in its turn, appears due to electrostriction of the piezoelectric layer of the structure. Such ferrite-piezoelectric structures could form a basis for elaboration of electrically and magnetically tuned microwave resonators and filters.

EXAMPLE 2

Band Pass Filters

The design and analysis of a new class of electric field-tunable ferrite-ferroelectric microwave band-pass filter is described. The tunability is possible through magnetoelectric interactions. When the composite is subjected to an electric field, the mechanical deformation due to piezoelectric effect manifests as a magnetic field shift in the ferromagnetic resonance (FMR) for the ferrite. The electrical tuning is much faster than traditional magnetic tuning and has practically zero power consumption.

Introduction: Ferrite-ferroelectric (FF) heterostructures are magnetoelectric (ME) due to their response to elastic and electromagnetic force fields (Schmid, H.: Introduction to complex mediums for optics and electromagnetics, Eds. W. S. Weiglhofer and A. Lakhtakia, SPIE Prsee, Bellingham, Wash. (2003), pp. 167-195, Srinivasan, G., Rasmussen, E. T., Gallegos, J., Srinivasan, R., Bokhan, Yu. I., And Laletin, V. M.:

Phys. Rev. B 64, 214408 (2001)). Such composites have permittivity, permeability and ME susceptibility characteristics suitable for reciprocal and nonreciprocal signal processing devices. Ferrites are used in traditional microwave/millimeter-wave devices in which tunability is realized through a variation of the bias magnetic field (ADAM, J. D., and STITZER, S, N.: *Appl. Phys. Lett.* 36, 485 (1980); Tsai, C. S., and Su, J.: *Appl. Phys. Lett.* 74, 2079 (1999)). This "magnetic" tuning could be achieved in a very wide frequency range, but is relatively slow and is associated with large power consumption. Similar devices but with some unique advantages could be realized with FF composites (Bichurin, M. I., Petrov, R. V., And Kiliba, Yu. V: *Ferroelectrics* 204, 311 (1997)). We recently developed a model for ME interactions at FMR in layered FF samples (Bichurin, M. I., Petrov, V. M., Kiliba, Yu. V., And Srinivasan G.: *Phys. Rev. B.* 66, 134404 (2002); Shastry, S., Srinivasan., Bichurin, M. I., Petrov, V. M., And Tatarenko, A. S.: *Phys. Rev. B.* 70, 064416 (2004)). An electric field E applied to the sample produces a mechanical deformation in the piezoelectric phase that in turn is coupled to the ferrite and manifests as a shift in the resonance field (Kittel formulas (1) and (2)). Thus, a microwave device based on FMR in a FF-composite could be tuned with an electric field. Such electrical tuning will be fast and passive, involving practically zero power consumption. This report is concerned with investigations on (i) microwave ME coupling in single crystal yttrium iron garnet (YIG)-lead magnesium niobate-lead titanate (PMN-PT) bilayers and (ii) design and theoretical predictions on electrically tunable YIG/PMN-PT band-pass filters. Our studies indicate a strong ME interaction with the ME constant A as high as 5.4 Oe cm/kV ("Microwave magnetoelectric effects in single crystal bilayers of yttrium iron garnet and lead magnesium niobate-lead titanate," S. Shastry, G. Srinivasan, M. I. Bichurin, V. M. Petrov, and A. S. Tatarenko, Phys. Rev. B. 70, 064416 (2004)). A 9.3 GHz filter based on the composite could be tuned over a 420 MHz range with E=0-30 kV/cm.

We first discuss results of our FMR studies on ME interactions in the bilayers at 9.3 GHz. These results are then utilized to obtain theoretical characteristics of an ME filter. Bilayers (4 mm×4 mm) were fabricated with 4.9-110 μm thick epitaxial (111) YIG films on gadolinium gallium garnet (GGG) substrates and 0.5 mm thick (001) PMN-PT. Gold electrodes (30 nm in thickness) were deposited on PMN-PT for electrical contacts and the crystal was initially poled by heating to 373 K and cooling it back to room temperature in E=2 kV/cm. A thin layer (<0.08 mm) of an epoxy, ethyl cyanoacrylate, was used to bond YIG to PMN-PT. The YIG film on the non-contact side was removed and GGG thickness was reduced to 0.1 mm by polishing. Microwave ME measurements at 9.3 GHz were performed using a traditional FMR spectrometer. A $TE_{102}$ reflection type cavity with Q of 2000 was used. The incident power on the cavity was kept small to avoid any sample heating at resonance. Holes (1 mm diameter) were made at the center of the cavity bottom and at λ/4 from the bottom on the narrow side. The bilayer was placed outside the cavity at these hole positions. Measurements were done with E perpendicular to the bilayer plane and for (i) H parallel to <111> of YIG and (ii) H parallel to (111)-plane of YIG. Absorption vs. H profiles were recorded for E=0-8 kV/cm.

Figure 5:
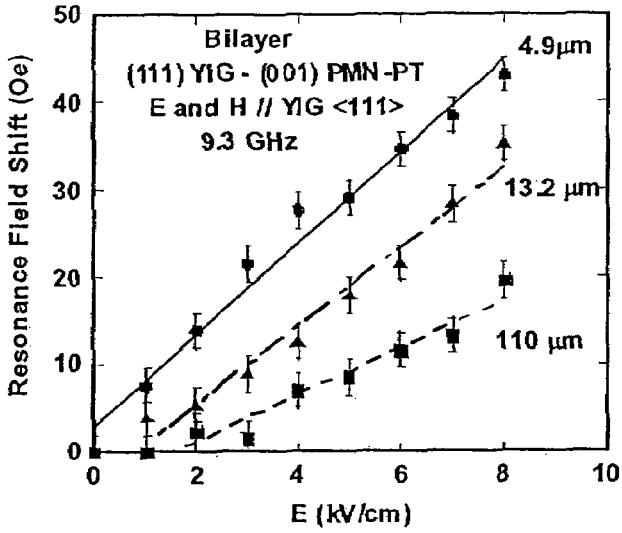
FIG. 5 is a graph showing microwave magnetoelectric effect at 9.3 GHz in bilayers of (111) YIG on GGG and (100) PMN-PT. The static fields E and H are parallel to <111> of YIG and is perpendicular to the bilayer plane. The shift in the resonance field $\delta H_E$ is shown as a function of E for a series of YIG film thickness. The lines are linear fit to the data.

Results: FIG. 5 shows representative data on electric field induced shift in the resonance field as a function of E at 9.3 GHz in the bilayers. Both E and H were along <111> of YIG, perpendicular to the sample plane. Consider first the results for the bilayer with 4.9 μm YIG. The condition for FMR is given by $$\omega/\gamma = H_r - 4\pi M_{eff} + AE \quad (1)$$

where ω is the angular frequency and γγ is the gyromagnetic ratio and $4\pi M_{eff}$ is the effective saturation induction, and A is the magnetoelectric constant. For E=0, the data showed FMR with a line-width ΔΔH=6±2 Oe. With the application of E=1 kV/cm, we measured an up-shift by $\delta H_E$=4 Oe in $H_r$, but ΔH remained the same. Further increase in E results in a linear increase in $H_r$. The ME constant $A=\delta H_E/E$ obtained from the data is 5.4 Oe cm/kV. Upon increasing the YIG thickness to 13.2 μm, one finds a similar behavior as for the bilayer with 4.9 μm film, but the ME constant is reduced to 4.4 Oe cm/kV. A further reduction in A to 2.3 Oe cm/kV is measured for the bilayer with 110 μm thick YIG. The field shift data in FIG. 5 cannot be due to sample heating. Based on the resonance condition in Eq. (1) any sample heating is expected to decrease the sample magnetization and thus decrease the external $H_r$ necessary for resonance. But the ME coupling manifests as an increase in $H_r$. Thus single crystal YIG/PMN-PT shows an order of magnitude stronger ME coupling than for bulk YIG-PZT (Bichurin, M. I., Petrov, V. M., Kiliba, Yu. V., and Srinivasan G.: *Phys. Rev. B.* 66, 134404 (2002)).

Figure 6A:
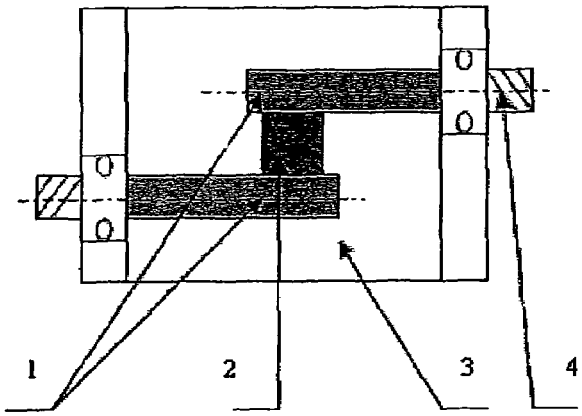
FIGS. 6A and 6B are schematic diagrams showing a single-cavity magnetoelectric filter (1—transmission lines, 2—ME resonator, 3—ground plane, 4—input/output) and the ME resonator.
Figure 6B:
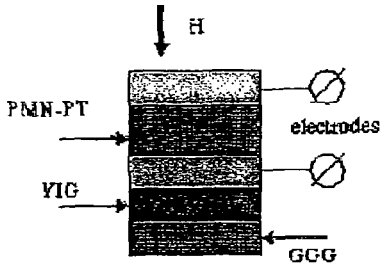

Magnetoelectric microwave filter: The results in FIG. 1 is important for a new class of electric field tunable magnetoelectric signal processing devices, such as a microwave band-pass filter shown in FIGS. 6A and 6B. The proposed single-resonator filter consists of microstrip transmission lines of nonresonant-length, a bilayer of YIG (GGG)/PMN-PT and a metal plated dielectric ground plane. Off-resonance input-output decoupling is determined by the gap between the transmission lines. Input-output coupling is realized when a bias field $H_r$ corresponding to FMR for YIG is present. It is clear from data in FIG. 5 that the filter could be tuned with an electric field applied to PMN-PT. The filter also functions as a power limiter at high input powers due to saturation of FMR.

For the estimation of device characteristics, we consider the transmission lines and the resonator as a single system that is described by a coupling coefficient. Then we obtain the coefficients of reflection, transmission and absorption for the case when an ME resonator is considered as an irregularity in the transmission line and give analysis of an electric tuning. The insertion losses for a single-resonator filter are determined by following expression (Carter, P.: *IEEE Trans. MTT,* 13, No. 3 (1965).):

$$L = -20 \log T, \quad (2)$$

$$\text{where } T = k/\sqrt{(1+k)^2+\xi^2}, \quad (3)$$

$$\xi = (H_r - H + \delta H)/\Delta H \quad (4)$$

$$k = (16VM_0 z_0/h^2 \lambda Z \Delta H)(\text{arctg}(Z/z_0\sqrt{\in}) + (1/3)\ \text{arctg}(3Z/z_0\sqrt{\in}))^2 \quad (5)$$

with Z=120π Ohm, $z_0$=50 Ohm.

Figure 7:
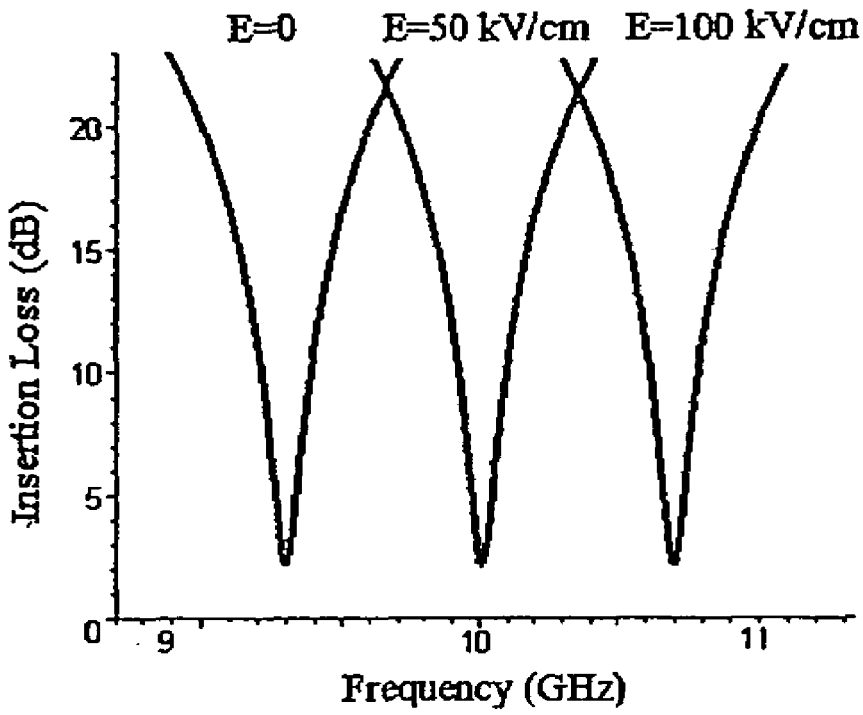
FIG. 7 is a graph showing theoretical estimates of the insertion loss vs. frequency characteristics for the filter for electric fields E=0, 50 kV/cm and 100 kV/cm and a bias magnetic field of 5 kOe.

Here T is transmission gain of the filter, V is the ME resonator volume, $M_0$ is the YIG saturation magnetization, $H_r$ is the resonance field, δH is the FMR line shift due to the electrical field, H is the dc magnetic field, ΔH is the half-width of FMR line, λ is the wavelength in transmission line, $z_0$ is the microstrip impedance, ∈ is the substrate permittivity, ξ is the combined detuning, and k is the single-resonator filter coupling coefficient. The key parameter for the filter, i.e., the insertion losses vs. frequency, was estimated and is shown in FIG. 7. The following parameters were assumed for the ME resonator and device structure: ground plane permittivity $\in$=10 and thickness h=2 mm, $4\pi M_0$=1760 Gauss, $\Delta H$=5 Oe, A=5 Oe cm/kV, ME resonator dimensions 4×1×0.605 $mm^3$, YIG film thickness of 4.9 μm, frequency of 9.3 GHz and a bias magnetic field value of 5 kOe. The most important inferences from FIG. 7 are the linear variation in the central frequency with E and the electric field tunability over a frequency band of 1.4 GHz. With a moderate E of 30 kV/cm, the breakdown field for air, the tunability is on the order of 420 MHz. The filter is predicted to have a bandwidth of 80 MHz. The insertion loss is the sum of losses in the ferrite and piezoelectric layers, metal conductors, dielectric substrate, and due to less-than-ideal coupling between the resonator and transmission lines. Under ideal conditions, a total insertion loss as low as 2.5 dB could be realized in the system.

In conclusion, microwave magnetoelectric coupling has been studied through FMR at 9.3 GHz in (111)YIG/(001) PMN-PT bilayers. The results are then used to estimate the performance characteristics of an electric field tunable YIG/PMN-PT band-pass filter.

EXAMPLE 3

Delay Lines

The electric field control of delay time is observed in a ferrite-ferroelectric microwave delay line. A microstrip delay line with a bilayer of (111) yttrium iron garnet film and (001) lead magnesium niobate-lead titanate (PMN-PT) is studied. A 10-25% variation in delay time is measured when the electric field applied to PMN-PT is increased from 0 to 8 kV/cm. The tunability is attributed to variations in the permittivity for PMN-PT in an electric field and its effect on the dispersion characteristics of hybrid spin electromagnetic waves that are excited in the bilayer.

PACS: 75.80.+q; 76.50.+g; 84.30.Vn; 84.40.-x

1. Introduction

Ferrite-film miniature delay lines are of interest for high frequency signal processing (J. D. Adam, M. R. Daniel, P. R. Emtage, and S. H. Talisa, in *Physics of Thin Films—Advances in Research and Development* (AP, Boston, 1991)). These devices are based on the propagation of magnetostatic spin waves (MSW) in the ferrite film that is placed across two microstrip transducers. The electromagnetic (EM) signal fed to the input transducer excites MSW in the film that propagates towards the output microstrip where it is converted back to EM signal. The MSW group velocity and the wavelength are two orders of magnitude smaller than for the EM waves of the same frequency. This makes possible a propagation delay time of about 10-500 ns for a propagation distance of several millimeters in the film.

The MSW frequency and group velocity depend on the magnitude of external bias magnetic field H. This allows magnetic field tuning of the operational frequency and delay time. Such magnetically tuned delay lines have been designed and tested in the past (J. D. Adam, M. R. Daniel, P. R. Emtage, and S. H. Talisa, in *Physics of Thin Films—Advances in Research and Development* (AP, Boston, 1991); L. R. Adkins, H. I. Glass, R. L. Carter, C. K. Wai, and J. M. Owens, *J. Appl. Phys,* 55, 2518 (1984)), but have several critical drawbacks including (i) limitations on the tuning speed due to the inductance associated with the tuning coil that produces the variable H, (ii) a large power requirement for the generation of H, and (iii) such systems cannot be made miniature in size.

One can overcome the above disadvantages by (i) replacing the ferrite film with a ferrite-ferroelectric bilayer and (ii) employing electric field tuning of the propagation characteristics of hybrid spin-electromagnetic (HSEM) waves (V. B. Anfinogenov, T. N. Verbitskaya, Y. V. Gulyev, P. E. Zil'berman, S. V. Meriakri, Y. F. Ogrin, and V. V. Tikhonov, *Sov. Tech. Phys. Lett.* 12, 389 (1986).). The tuning is possible through electrical field E dependence of the dielectric permittivity of the ferroelectric layer (E. Demidov, B. A. Kalinikos, and P. Edenhofer, *J. Appl. Phys.* 91, 10007 (2002).). Such a tuning mechanism for the delay time, in comparison with traditional magnetic tuning, is rapid and passive in terms of power requirements. Such devices can be made miniature in size.

This work constitutes the first report of electric field control of delay time in a ferrite-ferroelectric microwave delay line. We designed and characterized a yttrium iron garnet (YIG)/lead magnesium niobate-lead titanate (PMN-PT) delay line. A 10-25% variation in the delay time is measured when the electric field E applied to PMN-PT is increased from 0 to 8 kV/cm. Details on the device design and results are discussed next.

2. The Ferromagnetic-Ferroelectric Delay Line

Figure 8:
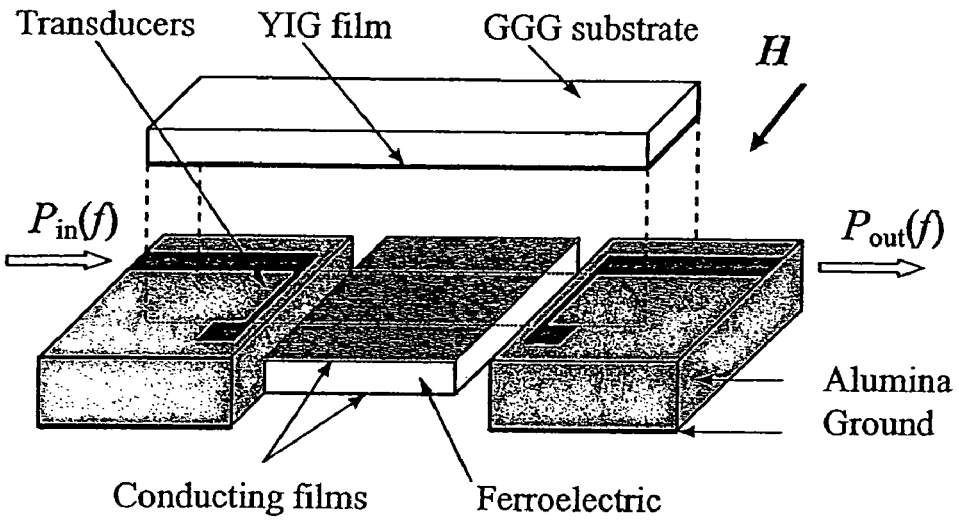
FIG. 8 is schematic view of a delay line based on layered ferromagnetic-ferroelectric structures. In this study, a bilayer with a 4.1 μm thick epitaxial yttrium iron garnet (YIG) film on (111) gadolinium gallium garnet (GGG) substrate and (001) lead magnesium niobate-lead titanate (PMN-PT) was used.

Schematics of the ferrite-ferroelectric delay line are shown in FIG. 8. The ferrite film used in the study was a 4.1 μm thick single crystal YIG film grown by the liquid-phase epitaxy on a gadolinium gallium garnet (GGG) substrate of (111) orientation. The film had lateral dimensions of 2×25 $mm^2$, a saturation magnetization of 1750 G, and ferromagnetic resonance line width of 0.65 Oe at 4 GHz. Two microstrip transducers of the width 50 μm and length of 3 mm, fabricated by photolithography on alumina substrates, were used to excite and detect the MSW. The distance 1 between the transducers was 8 mm. A (001) single crystal plate of PMN-PT with dimensions of 4×4×0.5 mm and a relative dielectric permittivity of $\in$ of 1520 at 2 MHz, was used for the ferroelectric phase. Both sides of PMN-PT plate were metalized (10 nm Cr sublayer and 200 nm Au layer) and the sample was poled by heating up to 140° C. and cooling back to room temperature in an electric field of 4 kV/cm perpendicular to the sample plane. The bilayer was made by bonding YIG to PMN-PT with a 0.08 mm thick layer of ethyl cyanoacrylate, a fast-dry epoxy. The MSW device structure with the YIG film was placed on the transducers and was subjected to a field H parallel to the transducers so that magnetostatic surface waves (MSSW) could be excited in the YIG film. The amplitude of such waves decays exponentially away from the film surface.

The measurements were carried out with a vector network analyzer (HP-8720D). An input cw signal $P_{in}(f)$ of frequency f=3-7 GHz and power $P_{in}$<1 mW was applied to the transducer. The frequency dependences of the insertion loss $L(f)=20\cdot\log[P_{out}(f)/P_{in}(f)]$ and phase shift $\phi(f)$ were measured as a function of H and the electrical field E applied across PMN-PT. The MSW dispersion characteristics for YIG film and YIG/PMN-PT bilayer were calculated from data on $\phi$ vs. f for MSSW and HSEM waves, respectively. The wave number k is given by $k(f)=\phi(f)/l$, with the phase $\phi$ expressed in radians. The delay time at each frequency was then estimated from the expression $\tau(f)=(1/2n)\cdot\partial\phi/\partial f$.

3. Results and Discussion

Figure 9A:
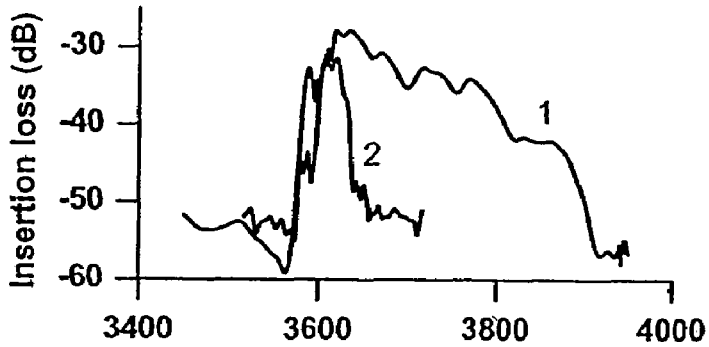
FIGS. 9A and 9B are graphs showing frequency dependences of (9A) the insertion loss and (9B) the delay time in the device structure of FIG. 8 for (1) YIG film and (2) YIG/PMN-PT bilayer. A bias field of H=701 Oe was applied parallel to the film or bilayer plane.
Figure 9B:
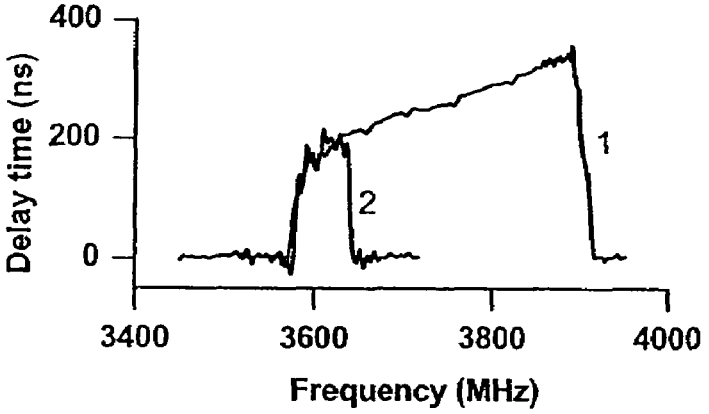

We first measured the dispersion characteristics of the ferrite-only MSSW delay line. Representative results on frequency dependences of the insertion loss (FIG. 9A) and delay time (FIG. 9B) are shown in FIGS. 9A and 9B under number (2) for H=701 Oe. The MSSW propagation occurs over the frequency band 3060-3914 MHz. A minimum in the insertion loss, −27 dB, occurs at ~3630 MHz. With increasing f, estimated wave number k increases from zero to a maximum of ~660 $cm^{-1}$ and is accompanied by a near-linear increase in the delay time τ, from ~166 to ~346 ns. The transmission loss L(f) and the delay τ(f) are determined by MSSW dispersion and excitation efficiency. The frequency profiles in FIGS. 9A and 9B(1) are well described by existing theories (J. D. Adam, M. R. Daniel, P. R. Emtage, and S. H. Talisa, in *Physics of Thin Films—Advances in Research and Development* (AP, Boston, 1991)).

Next, we performed similar insertion loss and delay measurements when the YIG film was replaced by YIG/PMN-PT bilayer and the data are shown in FIGS. 9A and 9B under number (2). The introduction of PMN-PT in the device structure resulted in two significant effects on the transmission response L(f): (i) an irregularity in the frequency interval f=3560-3590 MHz and (ii) a narrowing of the transmission band. The irregularity in FIG. 9A, close to the low-frequency boundary of the transmission band, reflects a change in the MSSW dispersion due to the formation of the HEMS wave. Recall that PMN-PT covers only the central 4 mm length of YIG film. Thus, wave propagation occurs first along a free ferrite surface, then on the ferrite-ferroelectrics interface, and finally along a free ferrite surface. The thickness of the metal layer on PMN-PT, between the ferrite and the ferroelectric, is ~0.2 μm and is much smaller than the skin depth (~3 μm). This allows microwave fields to penetrate the ferroelectrics. As a result, HSEM waves are formed in the ferrite-ferroelectrics structure in the low frequency (or small k) region, where the crossing of dispersion characteristics of the MSSW in the ferrite film and slow EM wave with TE polarization in the ferroelectric plate takes place (V. B. Anfinogenov, T. N. Verbitskaya, Y. V. Gulyev, P. E. Zil'berman, S. V. Meriakri, Y. F. Ogrin, and V. V. Tikhonov, *Sov. Tech. Phys. Lett.* 12, 389 (1986)). Calculations show that for parameters corresponding to the data in FIGS. 9A and 9B (2) shows, this crossing takes place at f ~3600 MHz (or k ~40 $cm^{-1}$), which is in good agreement with the observations. Second, the transmission band is narrowed down to ~3650 MHz. This narrowing is indicative of a substantial increase in the MSSW propagation losses for k>100 $cm^{-1}$ and is most likely due to finite conductivity of thin metal layer on the ferroelectrics surface and conductivity associated with PMN-PT itself (Y. K. Fetisov and I. G. Kudryashkin, *Sov. Tech. Phys. Lett.* 15, 47 (1989)).

Consider now the time delay profiles in FIG. 9B (2). The magnitude and f-dependence of τ(f) within the new transmission band remained nearly the same as for the free ferrite film. It is therefore clear that, in the present case, the presence of PMN-PT does not significantly alter the MSSW dispersion for frequencies above the hybridization point.

Figure 10:
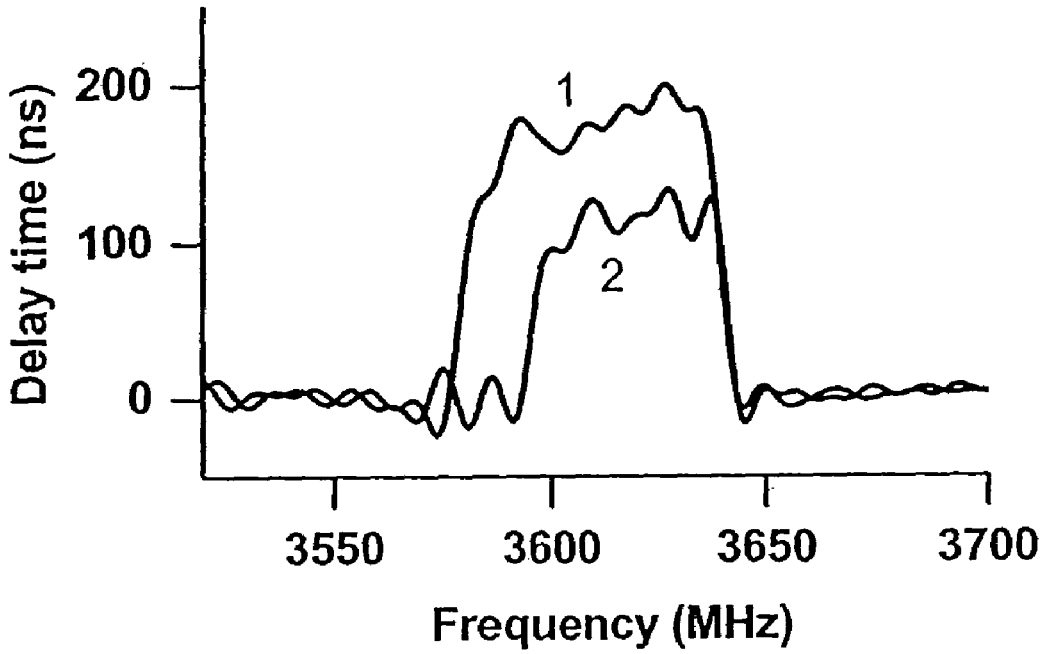
FIG. 10 is a graph showing delay time as a function of frequency for the YIG-PMN delay line (1) without an electrical field and (2) with E=8 kV/cm (2). The tangential bias magnetic field H is 701 Oe.

The primary interest here is the electric field control of the delay time and results of such measurements are shown in FIG. 10. We measured τ(f) vs. f for E applied parallel to the direction of initial polarization in PMN-PT. FIG. 10 shows (in expanded scale) delay time profiles for E=0 kV/cm (1) and 8 kV/cm (2). Application of E suppressed the signal transmission below ~3590 MHz. The most remarkable feature is the decrease in delay time by 25%, from ~180 ns down to ~120 ns, within the transmission band. A near-linear decrease in τ(f) with increasing E was measured for frequencies within the transmission band in FIG. 10. Profiles as in FIG. 10 were then obtained for central frequencies 3100-6100 MHz by tuning the field H from 542 Oe to 1500 Oe. The delay time tunability with E=8 kV/cm was in the range 10-25%. We did similar delay time measurements by reversing the direction of E. The delay time was E-dependent, but the overall change in τ was much smaller than for E parallel to the initial polarization.

We attribute tunability of τ in FIG. 10 to changes in the HSEM wave dispersion characteristics in an electric field. Dispersion characteristics and the group velocity of HSEM waves in the vicinity of the hybridization frequency depend on ∈ of PMN-PT (V. B. Anfinogenov, T. N. Verbitskaya, Y. V. Gulyev, P. E. Zil'berman, S. V. Meriakri, Y. F. Ogrin, and V. V. Tikhonov, *Sov. Tech. Phys. Lett.* 12, 389 (1986)). For E along the direction of initial polarization, ∈ at 2 MHz decreased from 1520 to 980 as E was increased from 0 to 8 kV/cm. But when E was reversed, ∈ did not change significantly. Thus, the application of a dc electrical field E results in a variation in ∈, leading to a change in the delay time. Recently, the influence of variations in ∈ on HSEM dispersion in a similar system, YIG-barium strontium titanate, was studied both theoretically (E. Demidov, B. A. Kalinikos, and P. Edenhofer, *J. Appl. Phys.* 91, 10007 (2002)) and experimentally (V. E. Demidov, B. A. Kalinikos, S. F. Karmanenko, A. A. Semenov, and P. Edenhofer, *IEEE Trans. MTT,* 51, 1576 (2003)). According to these reports, a decrease in ∈ from 2600 to 1700 is predicted to result in a considerable variation in the HSEM waves dispersion and the delay time. An additional factor that could contribute to the decrease in the delay time is an increase in the conductivity of PMN-PT in E.

In conclusion, we provided here the first data on the electric field control of the delay time in a microwave delay line with a YIG/PMN-PT bilayer. A nominal field of 8 kV/cm was found to produce a 25% change in the delay time. The tunability is accomplished through variation in ∈ for PMN-PT in electric fields. The delay time decreases due to the influence of ∈ on the dispersion characteristics of hybrid spin-electromagnetic waves that are excited in the bilayer.

EXAMPLE 4

Phase Shifters

Introduction: Tunable microwave phase shifters are attractive for miniature oscillators and phased array antenna systems. Such phase shifters can be realized based on magnetostatic spin waves (MSW) propogation in magnetized ferrite films (W. S. Ishak, *Proc. IEEE,* 1998, v. 91, No. 2, p. 171). The MSWs wave length and group velocity are 2-3 orders of magnitude smaller than for electromagnetic waves of the same frequency (R. W. Damon, J. R. Eshbach, *J. Phys. Chem. Solids,* 1961, v. 19, No. ¾, p. 308). This makes possible a phase shift of decades of π for propagation distances of several millimeters. Current MSW phase shifters use electromagnetic tuning systems that involves high power consumption, limitations on speed of the phase change, and large device dimensions.

This invention describes a novel MSW phase shifter using a ferrite film—piezoelectrics layered structure as a medium for MSWs propagation. Such a structure provides electrical control of the MSW phase shift due to magnetoelectric interactions in mechanically coupled piezoelectric and magnetostrictive layers (S. Shastri, G. Srinivasan, M. I. Bichurin, V. M. Petrov, and A. S. Taranenko, Phys. Rev. B., 2004, v. B70, p. 064416). The electric field tuning is fast and involves zero power consumption.

Phase-Shifter Design

FIG. 11 shows a schematic of the MSW phase-shifter. The ferrite film used in measurements was a 15 μm thick single crystal yttrium-iron garnet (YIG) film grown by the liquid-phase epitaxy on a gallium-gadolinium garnet (GGG) substrate of (111) orientation. The film has lateral dimensions of 2×25 $mm^2$, a saturation magnetization of 1750 G, and ferromagnetic resonance line width of ~0.6 Oe at 4 GHz. Two microstrip transducers of the width 50 μm and length of 4 mm, fabricated by photolithography on alumina substrates, were used to excite and detect the MSWs. The distance 1 between the transducers was 8 mm. A ceramic lead-zirconate-titanate (PZT) plate with dimensions of 4×4×0.5 $mm^3$ and electrostricton coefficient A=50 ppm/(V/cm) was used as a piezoelectric. Both sides of the PZT plate were metalized with a 5 μm thick Ag layer. In order to provide mechanical coupling, the PZT plate was bonded to the YIG film with a 0.08 mm thick layer of ethyl cyanoacrylate, a fast-dry epoxy. The bilayer was positioned in the MSW device structure with the YIG film placed on the transducers and was magnetized with an external field H produced by an electromagnet. The magnetic field was directed parallel to the transducers so that surface MSW are excited in the YIG film (R. W. Damon, J. R. Eshbach, *J. Phys. Chem. Solids,* 1961, v. 19, No. ¾, p. 308.).

The measurements were carried out with a vector network analyzer (HP-8720D). An input cw signal $P_{in}(f)$ of frequency f=1-10 GHz and power $P_{in}$=−10 dBm was applied to the input transducer. The frequency dependences of the insertion loss $L(f)=20\cdot\log[P_{out}(f)/P_{in}(f)]$ and phase shift $\phi(f)$ of the output signal were measured as a function of magnetic field H and the electrical field E applied across the PZT plate.

Phase-Shifter Characteristics

Typical measured insertion loss L(f) and phase shift $\phi(f)$ vs. frequency responses of the device for fixed H=750 Oe are shown in FIGS. 12A, 12B and 12C. Within frequency band of MSWs excitation, 3.8-4.1 GHz, the minimum loss (FIG. 12A) was equal to −20 dB, and it increased up to −45 dB out of the band. FIG. 12B shows a central part of the shifter phase characteristics, corresponding to minimum insertion loss region. Application of the electrical field E=8 kV/cm (FIG. 12C) to the piezoelectric plate resulted in an up shift of the phase characteristics on Δf=5 MHz. A down shift of the phase characteristics on Δf=−6 MHz was observed when the E field direction was reversed. No frequency shifts of the characteristics were observed when the YIG film was not mechanically bound to the PZT plate.

FIG. 13 shows measured E-field dependence of the phase characteristics shift for both electrical field directions at fixed H=750 Oe. In measurements, in order to suppress hysteresic repolarization of PZT. Nonlinearity of the dependence is due to nonlinearity of the PZT electrostriction.

FIGS. 14A and 14B shows dependence of maximum frequency shift Δf of the phase characteristics for E=±8 kV/cm as a function of a carrier frequency $f_0$, FIG. 14A—inside the MSW transmission band, and FIG. 14B—for operating frequencies corresponding to different magnetic fields H=336.2200 Oe. One can see that E-induced frequency shift remains nearly constant as the operating frequency changes in the wide band.

For a fixed frequency $f_0$, an E-induced variation in the signal phase is a linear function of the frequency shift Δf: $\Delta\phi=(\partial\phi/\partial f)|_{f_0}\cdot\Delta f=2\pi\tau(f_0)\cdot\Delta f$. Here τ(f) is the MSW delay time for the wave propagating along the YIG film—metalized PZT surface interface. The dependence τ(f) for surface MSW propagating along a metalized ferrite surface can be calculated using the known dispersion relation (S. R. Seshadri, *Proc. IEEE,* 1970, v. 58, No. 3, p. 506.). For typical values of τ=0.01-0.5 μm and measured Δf=5 MHz, one gets a range for electrical tuning of the signal phase is about of (0.1-2.5)π for fixed E direction.

It should be also noted, that described phase shifter, due to non-reciprocal propagation of the surface MSW, operates also as a microwave isolator. Insertion loss exceeds −40 dB for reversed direction of the signal propagation at any frequency.

Electrical tuning of the signal phase in the structure considered arises due to deformation induced changes in the MSW dispersion characteristics (N. I. Lyashenko, V. M. Talalaevskii, and L. V. Chevnyk, *Radiotechnika I Elektronika,* 1994, v. 39, No. 7, p. 1164 (in Russian)). In the structure proposed, it is piezoelectric plate which produces a deformation. Direct measurements with a strain gage showed that application of electrical field results in an expansion (or constriction, for reversed field direction) of the piezoelectric plate as large as 400 p.p.m. for E=8 kV/cm. This expansion creates a deformation in mechanically coupled YIG film. The deformation, due to magnetostriction effect, changes an effective internal magnetic field in the ferrite, followed by a frequency shift of the MSW phase characteristics.

As it has been demonstrated recently (S. Shastri, G. Srinivasan, M. I. Bichurin, V. M. Petrov, and A. S. Taranenko, *Phys. Rev. B.,* 2004, v. B70, p. 064416.), electrically induced shift of ferromagnetic resonance frequency in YIG-piezoelectric structures may reach a hundred of MHz. The optimization of the MSW phase shifter parameters will allow to decrease insertion loss and provide electrical tuning of the signal phase up to a decade of π radians.

In general, the ferrites layer(s) can be lithium ferrite, nickel zinc ferrite and hexagonal ferrites. These materials are well known to those skilled in the art. The piezoelectric layer(s) can be PZT which is Pb 1-x Zr(x) $TiO_3$ or PMN-PT which is (1-x) Pb Mg $NbO_3$-xPb $TiO_3$. Other piezoelectric materials can be used.

It is intended that the foregoing description be only illustrative of the present invention and that the present invention be limited only by the hereinafter appended claims.

I claim:

1. A device for electrical tuning of the operating frequency of a ferrite band-pass filter which comprises:

(a) input and output metal conducting strips spaced apart on non-conductive substrate;

(b) a piezoelectric layer with conductive layers on opposed sides of the layer; and (c) a ferrite film which is magnetically saturated mounted on the strips and bonded to one of the conductive electrode on the piezoelectric layer, wherein an electric field in the piezoelectric layer produces magnetostriction and additional magnetic field in the ferrite layer to produce a change in the resonant frequency thereby tuning the operating frequency.

2. The device of claim 1 wherein the ferrite film is a single crystal of yttrium gadolinium garnet (YIG) or substituted YIG.

3. The device of claim 2 wherein the garnet is deposited on a substrate of gallium gadolinium garnet (GGG).

4. The device of claim 1, 2 or 3 wherein the piezoelectric layer is lead zirconate-titanate (PZT) or lead magnesium niobate-lead titanate (PMN-PT).

5. The device of claim 1, 2 or 3 adapted for a frequency range of 1 to 20 GHz.

6. The device of claim 1, 2 or 3 as a microchip.

* * * * *

UNITED STATES PATENT AND TRADEMARK OFFICE

CERTIFICATE OF CORRECTION

PATENT NO. : 7,528,688 B2
APPLICATION NO. : 11/494427
DATED : May 5, 2009
INVENTOR(S) : Gopalan Srinivasan It is certified that error appears in the above-identified patent and that said Letters Patent is hereby corrected as shown below:

Column 7, line 33, "4nM=1750" should be --4πM=1750--.

Column 7, line 41, "$\delta f_1 \in \delta f_2$" should be --$\delta f_1$ и $\delta f_2$--.

Column 7, line 66, "5H" should be --δH--.

Column 7, line 67, "$5H_1$=5.77" should be --$\delta H_1$=5.77--.

Column 12, line 56, "(½ n)" should be --(½ π)--.

Signed and Sealed this

First Day of September, 2009

David J. Kappos

David J. Kappos
*Director of the United States Patent and Trademark Office*